US007464660B2

(12) United States Patent
Erskine

(10) Patent No.: US 7,464,660 B2
(45) Date of Patent: Dec. 16, 2008

(54) WINDSHIELD INCLUDING VENTED WALK-THROUGH DOOR

(75) Inventor: Edward J Erskine, Benson, NY (US)

(73) Assignee: Taylor Made Group, Inc., Gloversville, NY (US)

( * ) Notice: Subject to any disclaimer, the term of this patent is extended or adjusted under 35 U.S.C. 154(b) by 0 days.

(21) Appl. No.: 11/706,406

(22) Filed: Feb. 15, 2007

(65) Prior Publication Data

US 2008/0196653 A1 Aug. 21, 2008

(51) Int. Cl.
*B63B 17/00* (2006.01)

(52) U.S. Cl. ..... 114/361

(58) Field of Classification Search ..... 114/361; 296/96.11

See application file for complete search history.

(56) References Cited

U.S. PATENT DOCUMENTS 2,089,458 A * 8/1937 Westenfelder ..... 296/96.11
3,414,039 A * 12/1968 King ..... 160/90
3,438,073 A * 4/1969 Brown ..... 114/361
4,970,946 A * 11/1990 Ivey ..... 454/130
5,709,163 A * 1/1998 Livingston ..... 114/211
5,797,791 A * 8/1998 Humphrey et al. ..... 454/134

* cited by examiner

*Primary Examiner*—Stephen Avila
(74) *Attorney, Agent, or Firm*—Nixon & Vanderhye P.C.

(57) ABSTRACT

A windshield assembly for a covered vessel includes a door section forming part of the windshield. The door section includes a door section securable to the vessel and being substantially contiguous with the windshield. The door section includes a door frame pivotable between a closed position and an open position, and a door panel mounted in the door frame. The door panel includes a selectively vented opening. The windshield assembly including the door section provides access to a bow area on a front side of the windshield and also improves air circulation, cooling and ventilation through the cabin.

7 Claims, 3 Drawing Sheets

WINDSHIELD INCLUDING VENTED WALK-THROUGH DOOR

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates to a windshield assembly for a marine vessel or the like and, more particularly, to a windshield assembly including a vented walk-through door.

Many marine vessel designs include a passenger cabin or area and operator controls beginning near a midsection of the vessel hull. As a result, the vessel bow area can be large and is often suitable for occupant use, such as for sunbathing or the like. In order to provide access to the bow area, a pass-through may be provided in the windshield.

Marine vessels and the like including a closed cabin or an open cockpit with a temporary enclosure (such as a canvas top or the like) have ventilation concerns not found in vessels having an open deck. That is, in a closed cabin or covered cockpit, carbon monoxide exhaust from the engines can pervade the air within the closed canopy, causing potentially dangerous conditions for the operator and occupants. Additionally, airflow through the closed cabin or covered cockpit is desirable for cooling and ventilation, particularly on a hot day.

BRIEF SUMMARY OF THE INVENTION

It would thus be desirable to provide a windshield assembly for a marine vessel including a door section integrated with the windshield and serving as a pass-through for an occupant to access the vessel bow. In order to address air flow and venting concerns, the door section may be vented.

In an exemplary embodiment of the invention, a windshield for a covered vessel includes a windshield having at least a first section and a second section securable to a hull of the vessel, and a door section securable to the vessel and being substantially contiguous with the windshield. The door section includes a door frame pivotably attached between the first and second sections of the windshield and pivotable between a closed position and an open position. The door section also includes a door panel mounted in the door frame, wherein the door panel includes a selectively vented opening.

In one arrangement, the door section further includes a door casing secured to the vessel, where the door frame is pivotable in the door casing between the closed position and the open position. In this context, the door section preferably also includes a latch coupled with the door frame, which latch is selectively engageable with the door casing to lock the door frame in the closed position. The latch may alternatively be coupled with the door frame and selectively engageable with an adjacent one of the first and second windshield sections to lock the door frame in the closed position.

A seal may be disposed between the door frame and the first and second windshield sections.

The door panel preferably includes at least two panels, where the selectively vented opening is formed of at least one of the two panels being movable relative to the other between a vent open position and a vent closed position. In this context, the selectively vented opening may include a handle mechanism securing the movable panel in any position between the vent closed position and the vent open position.

In another exemplary embodiment of the invention, a door section forming part of a windshield includes a door frame pivotable between a closed position and an open position, and a door panel mounted in the door frame, wherein the door panel includes a selectively vented opening.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
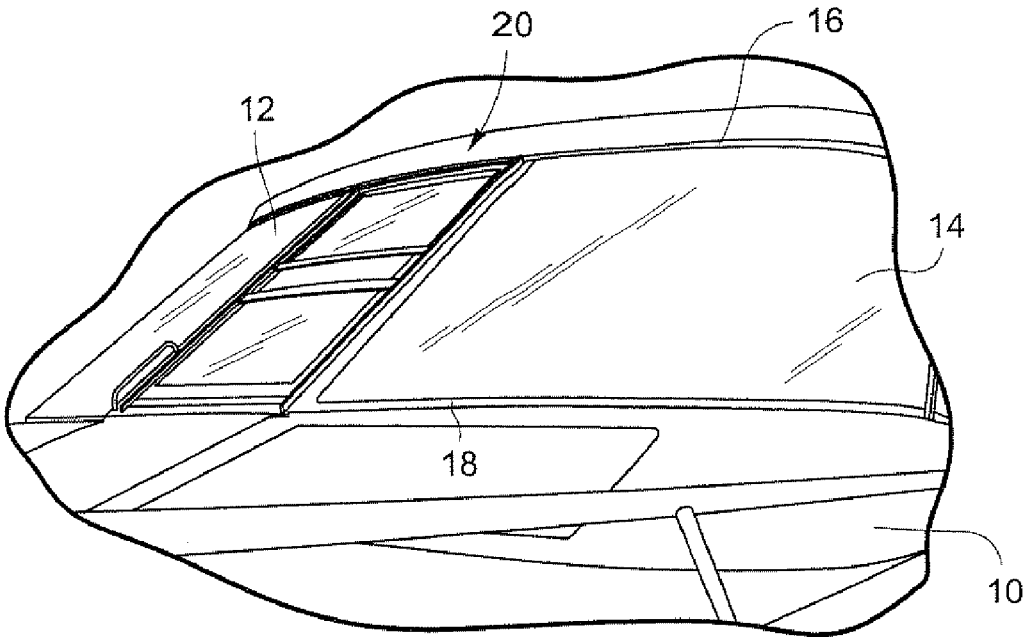
FIG. 1 is a front perspective view of an exemplary vessel including the windshield assembly described herein.

In the following detailed description, the windshield assembly is shown and described in an exemplary application to a boat. It should be understood by those of ordinary skill in the art, however, that the windshield assembly may be applicable in other environments, and the invention is not necessarily meant to be limited to the described exemplary application.

With reference to FIGS. 1-4, a windshield assembly 10 is provided for a covered vessel such as a boat or the like. The windshield assembly generally includes a windshield having at least a first section 12 and a second section 14. The windshield sections 12, 14 are secured to the vessel in a conventional manner between a top trim 16 securable to a canopy of the vessel (if a canopy is included) and a bottom trim 18 securable to a hull of the vessel. Many variations of the top and bottom trim for securing the windshield sections to the vessel are known, and those of ordinary skill in the art will appreciate that any suitable structure may be used. The details of the top and bottom trims 16, 18 will thus not be further described.

A door section 20 is securable to the vessel between the windshield sections 12, 14. As shown, the door section 20 is substantially contiguous with the windshield sections 12, 14. The term "substantially contiguous" in this context refers to the door section appearing to form part of the windshield. In this context, the door section need not necessarily be aligned with or flush to the windshield sections, but from an ordinary observer's perspective, the door section appears part of the vessel windshield. In an alternative arrangement, the door section forms part of the windshield, where the windshield includes multiple sections such as fixed sections and a door section.

Figure 2:
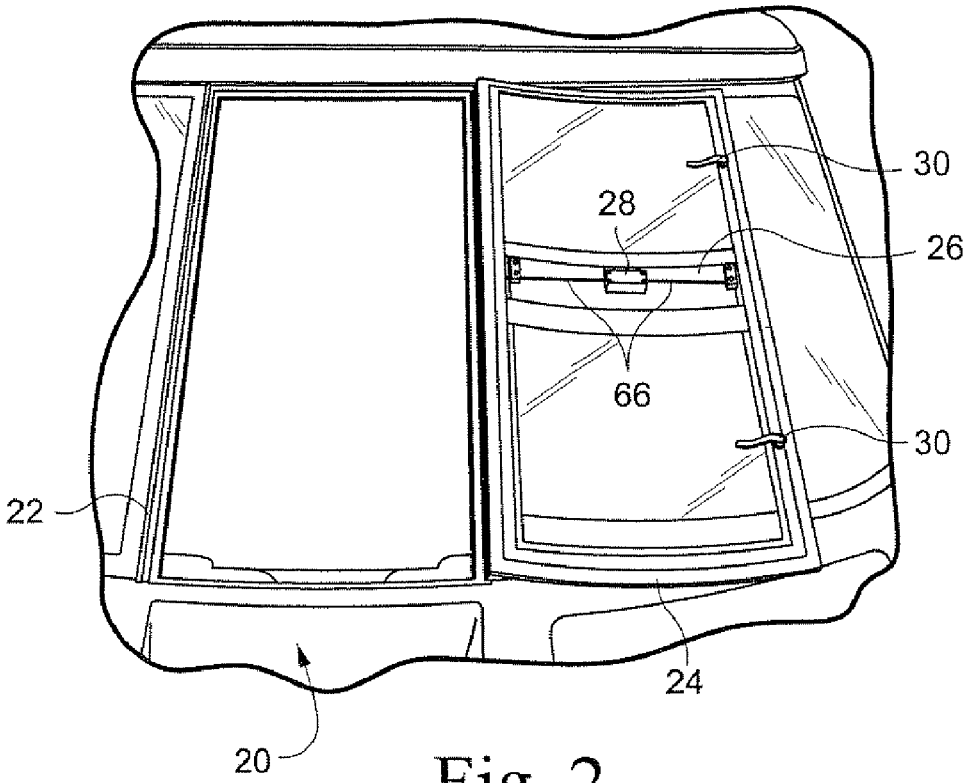
FIGS. 2 and 3 show the windshield assembly with the door section in an open position.
Figure 3:
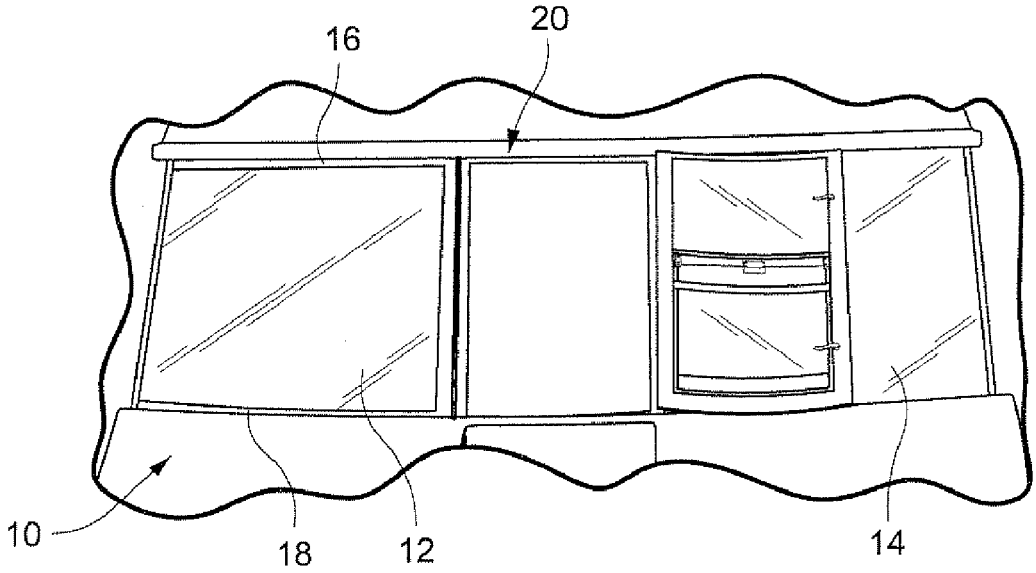
Figure 4:
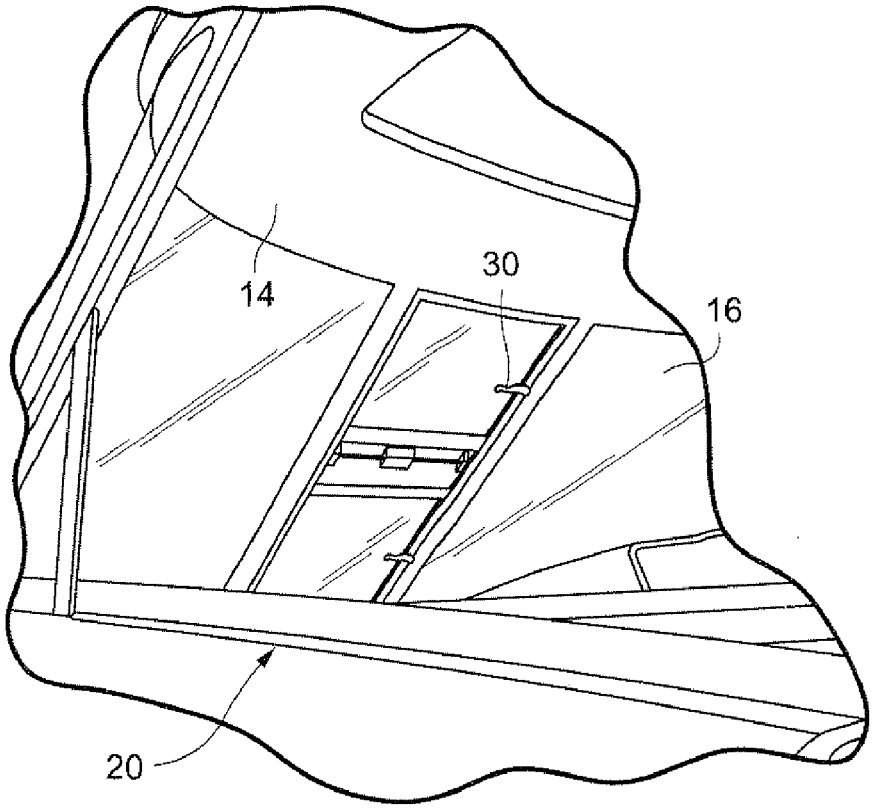
FIG. 4 is an opposite side view of the windshield assembly with the door section in a closed position.

With reference to FIG. 2, the door section 20 includes a door casing 22 secured to the vessel and the windshield sections 12, 14, and a door frame 24 pivotable in the door casing via suitable hinges or the like between a closed position (shown in FIGS. 1 and 4) and an open position (shown in FIGS. 2 and 3). For a vessel including a canopy, the door casing 22 is preferably fastened to the hull and canopy. For a vessel without a canopy, the door casing 22 may be fastened only to the hull or the assembly may not include a door casing, and the door frame can be connected directly with adjacent windshield sections. A suitable seal is disposed between the door frame 24 and the first and second windshield sections 12, 14.

At least one door panel 26 is mounted in the door frame 24. In a preferred arrangement, the door panel 26 includes a selectively vented opening to enable air flow through the door section 20 when the door frame 24 is in the closed position. In a preferred embodiment, two door panels are provided including a fixed panel (e.g., the lower panel in the FIGURES) and a sliding panel (e.g., the upper panel in the FIGURES). In this preferred arrangement, a handle mechanism or clasp assembly 28 is secured to the slidable panel and serves to secure the slidable panel in any position between a closed position and a fully open position. The vent may alternatively be electrically operated.

The door section 20 additionally includes a suitable latch 30 coupled with the door frame 24. The latch 30 is selectively engageable with the door casing 22 to lock the door frame 24 in the closed position. Any suitable latch mechanism may be used as would be apparent to those of ordinary skill in the art.

Figure 5:
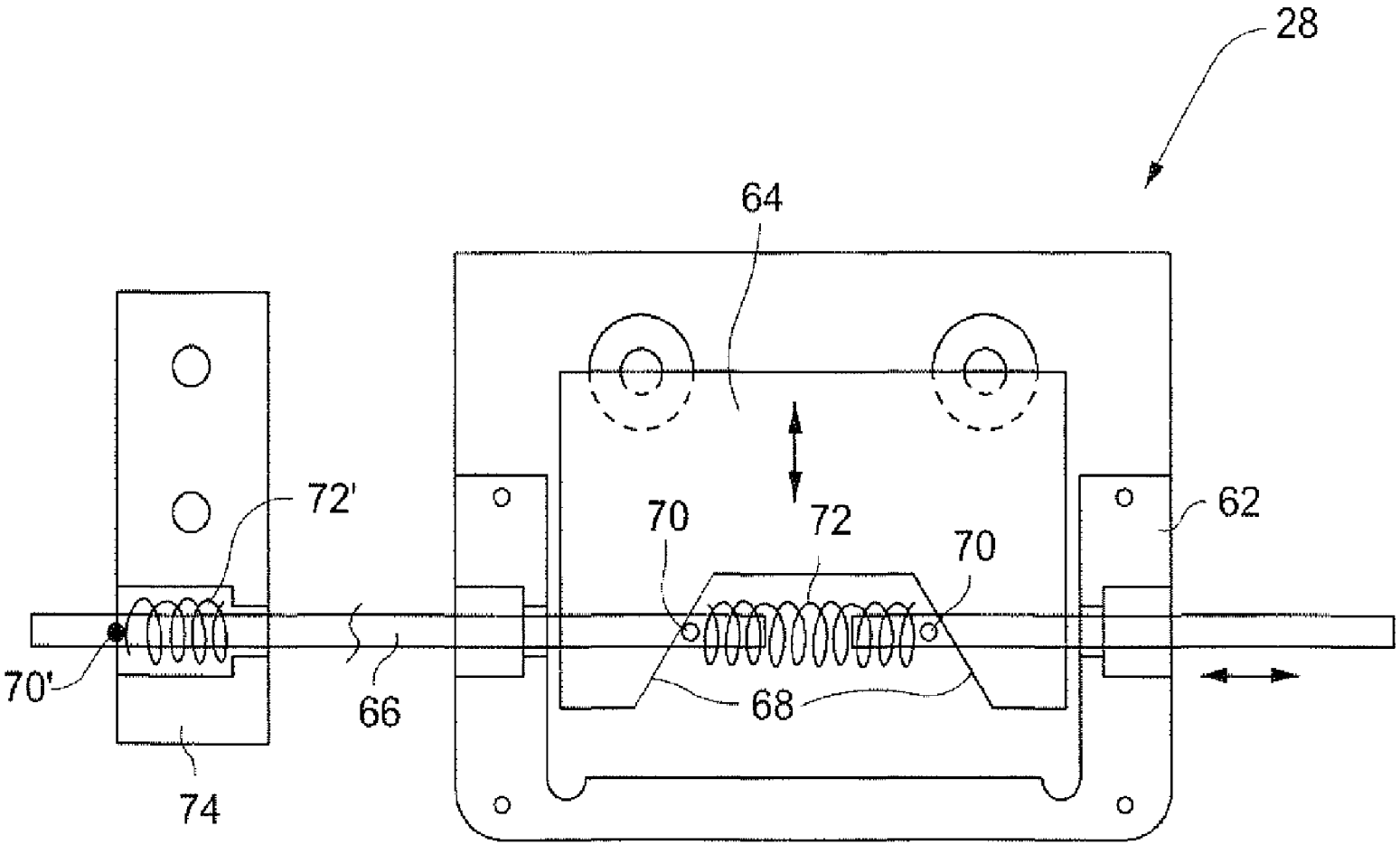
FIG. 5 illustrates an exemplary handle mechanism for securing the vented opening.

An exemplary handle mechanism or clasp assembly 28 is shown in FIG. 5 with its cover removed. The mechanism 28 includes an actuator box 62 and an actuator 64 disposed in the box 62. Locking rods 66 are selectively engageable with the door frame 24 to secure the slidable panel 26 in a desired position. In an exemplary construction, a plastic strip or the like including a plurality of apertures is fixed to the door frame 24, and the locking rods 66 are selectively engageable with the apertures to secure the slidable panel 26 in a desired position.

The locking rods 66 extend through openings in the actuator box 62 and through openings in the actuator 64. The actuator 64 includes a pair of cam surfaces 68. In one embodiment, each of the locking rods 66 includes a roll pin 70 engaging the cam surfaces 68. A spring 72 urges the locking rods 66 outward toward engagement with the door frame 24.

In use, the locking rods 66 are biased toward engagement with the door frame 24 by the spring 72. When an operator presses down or squeezes the actuator 64, the downward force causes the cam surfaces 68 to drive the roll pins 70 inward, thereby retracting the locking rods 66 from the door frame 24. When the actuator 64 is released, the spring 72 urges the actuator 64 back up to its resting position and urges the locking rods 66 back into engagement with the door frame 24. In an alternative construction, a spring 72' may instead act on an opposite end of the locking rods 66 within a rod guide 74. The spring 72' in this construction pushes against a roll pin 70' secured at the locking rod ends.

The windshield assembly described herein provides a passageway for occupants of a boat or the like to access the bow. Additionally, the door section of the windshield assembly includes a selectively vented opening to improve air circulation and cooling through the cabin and prevent accumulation of carbon monoxide.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A windshield assembly for a covered vessel, the windshield assembly comprising:

a windshield including at least a first section and a second section securable at a bottom to a hull of the vessel and at a top to a vessel cover; and a door section securable to the vessel and being substantially contiguous with the windshield, the door section including a door frame pivotably attached between the first and second sections of the windshield and pivotable on a non-vertical axis extending along a line between the hull and the vessel cover between a closed position and an open position, and a door panel mounted in the door frame, wherein the door panel includes a movable panel defining a selectively vented opening, the movable panel comprising a handle mechanism securing the movable panel in at least one position between a vent closed position and a vent open position regardless of a position of the door frame, wherein the handle mechanism comprises a pair of locking rods selectively engageable with the door frame, and an actuator box including cam surfaces cooperable with the locking rods to retract the locking rods from the door frame when the actuator box is displaced in a first direction, the actuator box being biased toward a second direction, opposite from the first direction, by a spring, wherein the actuator box is sized for one-hand operation.

2. A windshield assembly according to claim 1, wherein the door section further comprises a door casing secured to the vessel, and wherein the door frame is pivotable in the door casing between the closed position and the open position.

3. A windshield assembly according to claim 2, wherein the door section further comprises a latch coupled with the door frame, the latch being selectively engageable with the door casing to lock the door frame in the closed position.

4. A windshield assembly according to claim 1, further comprising a seal disposed between the door frame and the first and second windshield sections.

5. A windshield assembly according to claim 1, wherein the door section further comprises a latch coupled with the door frame, the latch being selectively engageable with an adjacent one of the first and second windshield sections to lock the door frame in the closed position.

6. A windshield assembly for a covered vessel, the windshield assembly comprising:

a windshield including at least a first section and a second section securable at a bottom to a hull of the vessel and at a top to a vessel cover; and a door section securable to the vessel and being substantially contiguous with the windshield, the door section including a door frame pivotably attached between the first and second sections of the windshield and pivotable on a non-vertical axis extending along a line between the hull and the vessel cover between a closed position and an open position, and a door panel mounted in the door frame, wherein the door panel includes a selectively vented opening, wherein the door panel comprises at least two panels, wherein the selectively vented opening comprises at least one of the two panels being movable relative to the other between a vent open position and a vent closed position, and wherein the selectively vented opening comprises a handle mechanism securing the movable panel in any position between the vent closed position and the vent open position, wherein the handle mechanism comprises a pair of locking rods selectively engageable with the door frame, and an actuator box including cam surfaces cooperable with the locking rods to retract the locking rods from the door frame when the actuator box is displaced in the first direction, the actuator box being biased toward the second direction, opposite from the first direction, by a spring, wherein the actuator box is sized for one-hand operation.

7. A windshield comprising:

at least one fixed section securable between a vessel hull and a vessel cover; and a door section securable to the vessel hull and including a door frame pivotably attached adjacent the fixed section and pivotable on a non-vertical axis extending along a line between the vessel hull and the vessel cover between a closed position and an open position, and a door panel mounted in the door frame, wherein the door panel includes a movable panel defining a selectively vented opening, the movable panel comprising a handle mechanism securing the movable panel in at least one position between a vent closed position and a vent open position regardless of a position of the door frame, wherein the handle mechanism comprises a pair of locking rods selectively engageable with the door frame, and an actuator box including cam surfaces cooperable with the locking rods to retract the locking rods from the door frame when the actuator box is displaced in a first direction, the actuator box being biased toward a second direction, opposite from the first direction, by a spring, wherein the actuator box is sized for one-hand operation.

* * * * *